US006851922B2

(12) United States Patent
Kuehn et al.

(10) Patent No.: US 6,851,922 B2
(45) Date of Patent: Feb. 8, 2005

(54) PUMP FOR PUMPING FUEL FROM A TANK TO AN INTERNAL COMBUSTION ENGINE OF A MOTOR VEHICLE

(75) Inventors: Michael Kuehn, Bietigheim-Bissingen (DE); Willi Strohl, Anderson, SC (US); Hans-Joerg Fees, Bietigheim-Bissingen (DE); Thomas Wieland, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/333,077

(22) PCT Filed: Apr. 17, 2002

(86) PCT No.: PCT/DE02/01419

§ 371 (c)(1),
(2), (4) Date: Sep. 5, 2003

(87) PCT Pub. No.: WO02/093014

PCT Pub. Date: Nov. 21, 2002

(65) Prior Publication Data

US 2004/0028520 A1 Feb. 12, 2004

(30) Foreign Application Priority Data

May 17, 2001 (DE) ..... 101 23 992

(51) Int. Cl.[7] ..... F04D 1/04
(52) U.S. Cl. ..... 415/55.1; 416/234
(58) Field of Search ..... 415/55.1, 55.2, 415/55.5, 55.6; 416/234

(56) References Cited

U.S. PATENT DOCUMENTS

| | | | | |
|---|---|---|---|---|
| 2,724,338 A | | 11/1955 | Roth | |
| 5,011,367 A | | 4/1991 | Yoshida | |
| 5,328,325 A | * | 7/1994 | Strohl et al. | 415/55.1 |
| 5,449,269 A | * | 9/1995 | Frank et al. | 415/55.1 |
| 5,468,119 A | * | 11/1995 | Huebel et al. | 415/55.1 |
| 5,551,835 A | | 9/1996 | Yu | |

FOREIGN PATENT DOCUMENTS

EP 0 978 656 A1 9/2000

* cited by examiner

*Primary Examiner*—Ninh H. Nguyen
(74) *Attorney, Agent, or Firm*—Ronald E. Greigg

(57) ABSTRACT

The flow pump has an impeller, driven in a pump chamber and having a ring of blades spaced apart from one another in the circumferential direction on at least one end face and ending at the face end of the impeller and cooperate therewith to define blade chambers. In the pump chamber, at least one feed conduit in the form of a split ring cooperates with the ring of blades on the impeller, and at least one intake opening discharging into the feed conduit is embodied in a pump chamber wall that defines the pump chamber in the direction of the pivot axis of the impeller. In an initial region at the at least one intake opening and/or in the circumferential direction of the impeller, adjoining the impeller, the feed conduit extends radially farther inward than the blade chamber bottom of the impeller, and the transition between a radially inner blade chamber bottom of the blade chambers and the associated face end of the impeller has a chamfer or rounded corner.

12 Claims, 2 Drawing Sheets

PUMP FOR PUMPING FUEL FROM A TANK TO AN INTERNAL COMBUSTION ENGINE OF A MOTOR VEHICLE

CROSS-REFERENCE TO RELATED APPLICATIONS

This application is a 35 USC 371 application of PCT/DE 02/01419 filed on Apr. 17, 2002.

BACKGROUND OF THE INVENTION

1. Field of the Invention

The invention is directed to an improved flow pump, in particular for pumping fuel from a tank to an internal combustion engine of a motor vehicle.

2. Description of the Prior Art

One flow pump of the type with which this invention is concerned is known from German Patent Disclosure DE 43 40 011 A1. This flow pump has an impeller driven to revolve in a pump chamber and on at least one face end has a ring of blades spaced apart from one another in the circumferential direction. The blades end at the face end of the impeller and between them define blade chambers, which have a radially inner blade chamber bottom. In the pump chamber, at least one feed conduit is embodied in the form of a split ring, cooperating with the blades of the impeller. An intake opening discharging into the feed conduit is embodied in a pump chamber wall that defines the pump chamber in the direction of the pivot axis of the impeller. At least one outlet opening also discharges into the pump chamber. It has been demonstrated that in this known flow pump, when hot fuel is pumped, the supply quantity drops sharply because of the development of vapor bubbles. The development of vapor bubbles occurs above all in the region of low pressures and thus in the region of the intake opening. At that location, the embodiment of the feed conduit and of the impeller in the known flow pump is not optimal.

SUMMARY OF THE INVENTION

The flow pump of the invention has the advantage over the prior art that because the feed conduit is embodied as extending radially farther inward, and because of the chamfered or rounded transition of the blade chamber bottom of the blade chambers of the impeller, a better inflow of the fuel is achieved, and thus with hot fuel, fewer vapor bubbles are formed, and the pumping properties of the flow pump are improved.

BRIEF DESCRIPTION OF THE DRAWINGS

One exemplary embodiment of the invention is explained in further detail herein below, with references to the drawings, in which.

DESCRIPTION OF THE PREFERRED EMBODIMENT

Figure 1:
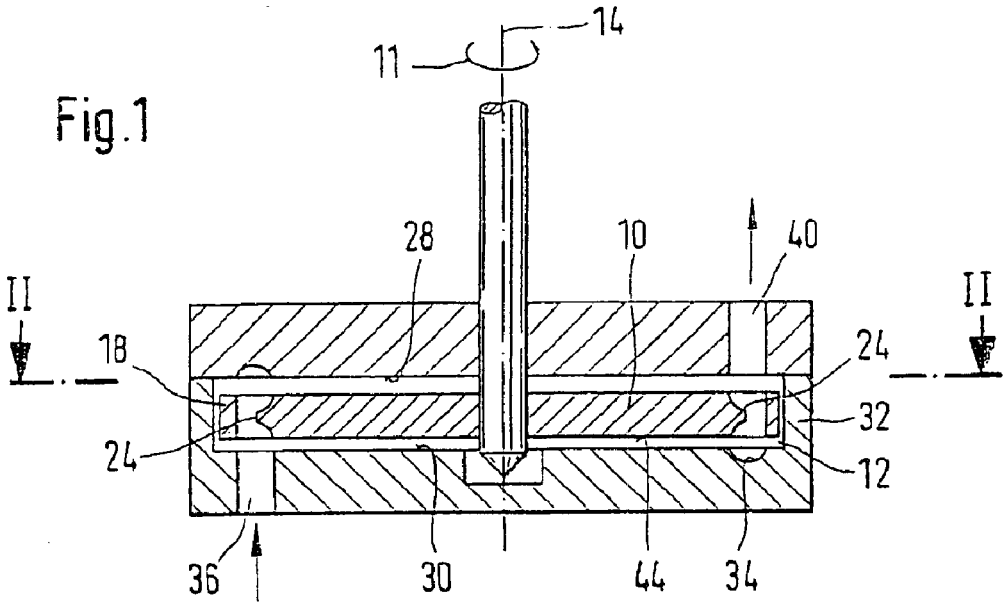
FIG. 1 shows a flow pump in an axial longitudinal section.
Figure 2:
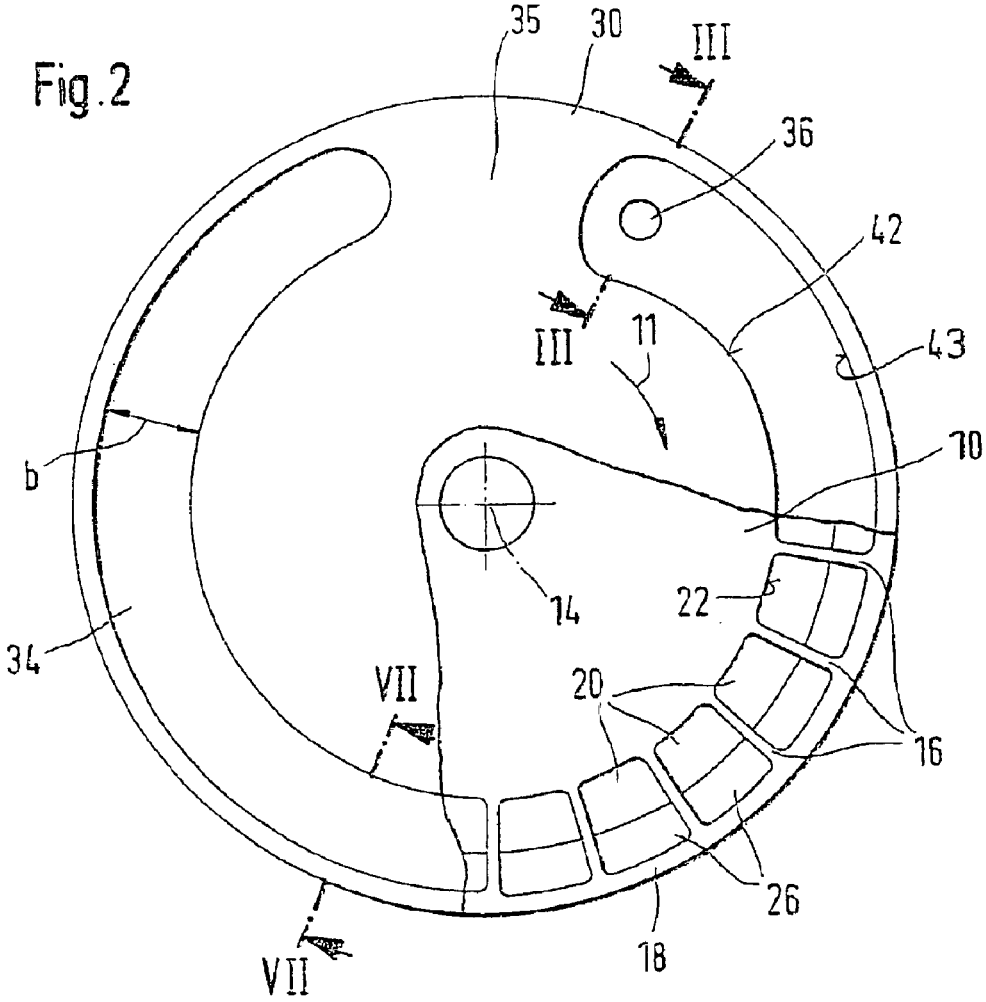
FIG. 2 shows the flow pump in a cross section taken along the line II—II in FIG. 1.

In FIGS. 1–7, a flow pump is shown that serves in particular to pump fuel from a fuel tank to an internal combustion engine of a motor vehicle. The flow pump is combined with an electrical drive motor, not shown, into a pumping unit, in which the flow pump and the drive motor are disposed in the same housing. The flow pump has an impeller 10, which is disposed in a pump chamber 12 and is driven to revolve about an axis 14 by the drive motor. On one or both face ends, the impeller 10 has a ring of blades 16 spaced apart from one another in the circumferential direction. The blades 16 can be embodied in flat form, can be disposed radially or inclined to a radial direction relative to the pivot axis 14 of the impeller, and alternatively can also be embodied as curved or spiraled. The blades 16 can be joined to one another on their radially outer ends via a ring 18. Alternatively, it can also be provided that the blades 16 end at the outer circumference of the impeller 10 and that no ring 18 is provided. The impeller 10 can comprise plastic, metal, in particular lightweight cast metal, ceramic material, or some other suitable material.

Between them, the blades 16 define blade chambers 20, which radially inward each have a respective blade chamber bottom 22. The blade chamber bottom 22 is embodied as concavely rounded, for instance. Between the blade chambers 20 of the blades 16 disposed on opposed face ends of the impeller 10, centrally in the impeller 10, a radially outward-pointing partition 24 is embodied, but it does not extend as far as the ring 18, so that there is an opening 26 present there, through which the rings of chambers defined by blades 16 disposed on both face ends of the impeller 10, are joined together.

The pump chamber 12 is defined in the direction of the pivot axis 14 of the impeller 10 by a pump chamber wall 28 on the one hand, toward the drive motor, and on the other by a pump chamber wall 30. The pump chamber wall 30 can form a closure cap for the housing that receives the flow pump. In the radial direction relative to the pivot axis 14 of the impeller 10, the pump chamber 12 is defined by a circumferential chamber wall 32, which may be embodied integrally with one of the pump chamber walls 28, 30. The pump chamber walls 28, 30, 32 can comprise plastic, metal, in particular lightweight cast metal, ceramic material, or some other suitable material. In the face end of the pump chamber wall 30 oriented toward the impeller 10, a groove 34 that at least approximately coaxially, in the form of a split ring, surrounding the pivot axis 14 of the impeller 10 and that forms a feed conduit that cooperates with the ring, facing the groove, of blades 16 of the impeller 10. An intake opening 36 that penetrates the pump chamber wall 30 discharges into an initial region of the groove 34 that points counter to the direction 11 of revolution of the impeller 10. An at least approximately coaxial groove 38 in the form of a split ring surrounding the pivot axis 14 of the impeller 10 can also be embodied in the pump chamber wall 28, in its face end oriented toward the impeller 10; this groove forms a feed conduit that cooperates with the ring, facing it, of blades 16 of the impeller 10. At least one outlet opening 40 discharges into the groove 38, in its end region pointing in the direction 11 of revolution of the impeller 10. The grooves 34 and 38 in the pump chamber walls 30 and 28 are embodied mirror-symmetrically to and facing one another, and between the end region and their initial region, there is a interrupter region 35 for the groove 34 and a corresponding interrupter region for the groove 38, in order to separate the initial regions and end regions from one another. The grooves 34, 38 are preferably embodied as rounded in cross section, for instance being at least approximately in the form of a segment of a circle, but can also be embodied trapezoidally or with some other cross-sectional shape.

Figure 3:
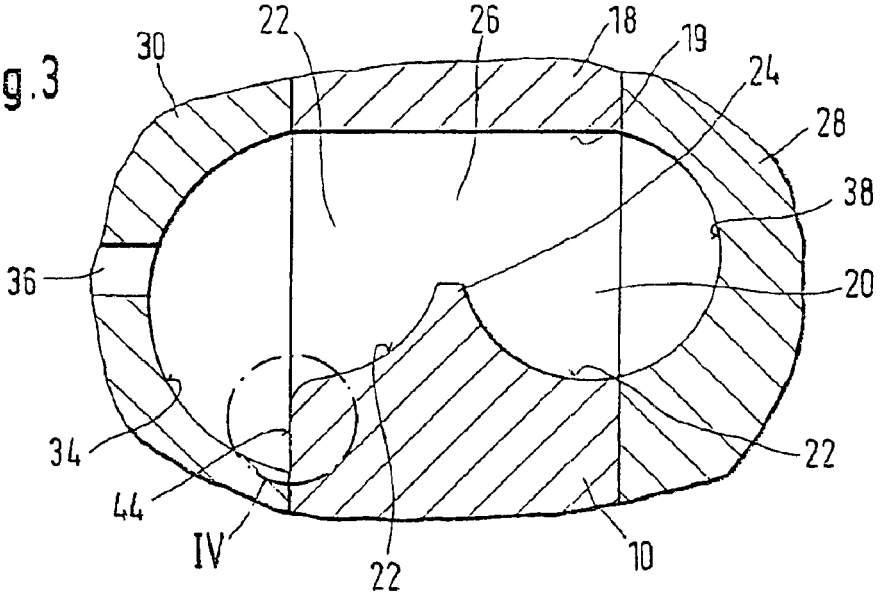
FIG. 3 shows a detail of the flow pump in a longitudinal section taken along the line III—III in FIG. 2, on a larger scale.
Figure 7:
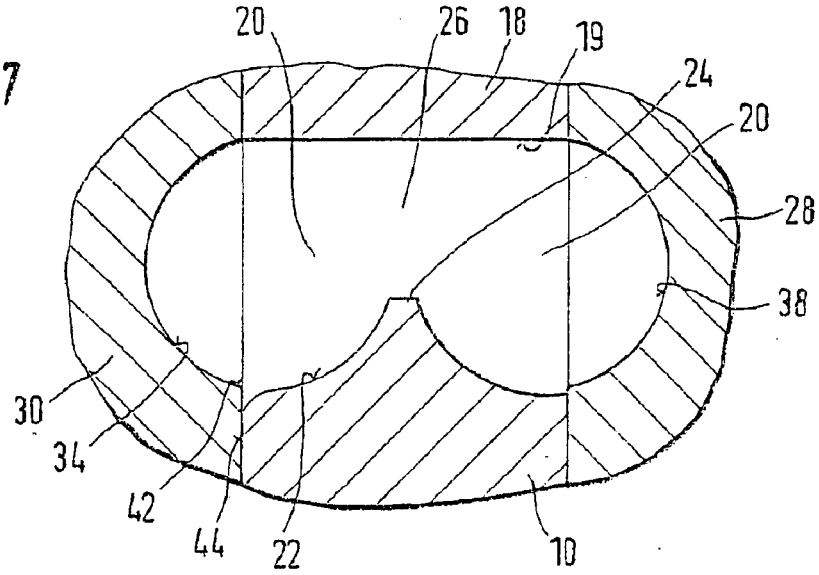
FIG. 7 shows a detail of the flow pump in a longitudinal section taken along the line VII—VII in FIG. 2, on a larger scale.

The groove 34 in the pump chamber wall 30 has a radially inner edge 42. In the circumferential region of the intake opening 36 and in an initial region adjoining it in the direction 11 of revolution of the impeller 10, the groove 34, with its edge 42, extends radially farther inward than the blade chamber bottom 22 of the blades 16 on the face end, oriented toward the groove 34, of the impeller 10, as FIG. 3 shows. The intake opening 36 has a lesser width in the radial direction than the groove 34 and can discharge at least approximately centrally into the groove 34, or can discharge into it closer to its radially inner edge 42. The radial width b of the groove 34 decreases, beginning at its initial region, with the orifice of the intake opening 36 in the direction 11 of revolution of the impeller 10, because the inner edge 42 extends radially farther outward. The radially outer edge 43 of the groove 34 extends at an at least approximately constant radius over the entire circumference of the groove 34. The radially outer edge 43 of the groove 34 extends at least approximately over the same radius as the radially inner edge 19 of the ring 18 of the impeller 10. In the remaining circumferential region outside the initial region, the radial width b of the groove 34 is at least approximately constant; the inner edge 42 of the groove 34 extends at least approximately over the same radius as the blade chamber bottom 22, facing it, of the impeller 10, as FIG. 7 shows. The course of the inner edge 42 of the groove 34, beginning at the initial region, is continuous to the remaining circumferential region of the groove 34, but it can also be graduated.

Figure 4:
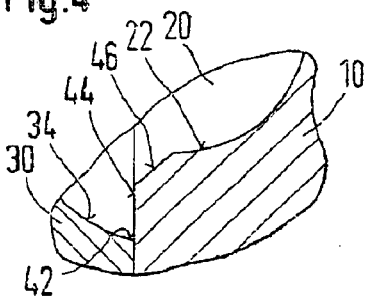
FIG. 4 shows a detail marked IV in FIG. 3, on a larger scale.
Figure 5:
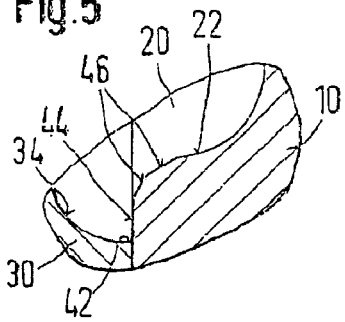
FIG. 5 shows a modified version of FIG. 4.
Figure 6:
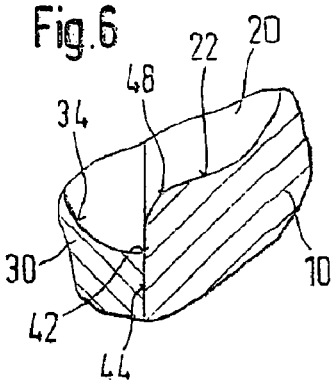
FIG. 6 shows a further modified version of FIG. 4.

At the face end 44, toward the groove 34, of the impeller 10, the transition from the blade chamber bottom 22 to the face end 44 has a chamfer 46 in the form of a bevel, as shown in FIG. 4. The chamfer 46 can for example extend at an angle of approximately 45° to the face end 44, or at some arbitrary other angle. It is also possible, as shown in FIG. 5, for a plurality of portions of chamfers 46 to be provided, extending at different angles. Alternatively, the transition from the blade chamber bottom 22 to the face end 44 can also have a convex rounded corner 48, as shown in FIG. 6. The rounded corner 48 can be formed from one radius, or from portions of different radii.

It can also be provided that the impeller 10 has no ring 18; then its blades 16 and at the radial jacket of the impeller 10, and the grooves 34, 38, forming feed conduits, of the pump chamber walls 30, 28 extend radially farther outward than the impeller 10. Thus the feed conduits 34, 38 are joined together via the outer circumference of the impeller 10. In this embodiment as well, the radially inner edge 42 of the groove 34 of the pump chamber wall 28 extends radially farther inward than the blade chamber bottom 22 of the blades 16, facing it, of the impeller 10, and the transition at the blade chamber bottom 22 has the chamfer 46 or the rounded corner 48.

In operation of the flow pump, this pump aspirates fuel through the intake opening 36 that is carried along through the impeller 10, in cooperation with the grooves 34, 38 that form the feed conduits, raising the pressure of the fuel. The fuel emerges through the outlet opening 40 and reaches an injection system of the internal combustion engine of the motor vehicle.

The foregoing relates to preferred exemplary embodiments of the invention, it being understood that other variants and embodiments thereof are possible within the spirit and scope of the invention, the latter being defined by the appended claims.

What is claimed is:

1. A flow pump for pumping fuel from a fuel tank to an internal combustion engine of a motor vehicle, comprising an impeller (10) driven to revolve about a pivot axis (14) in a pump chamber (12), a ring of blades (16) on at least one face end of the impeller (10) and spaced apart from one another in the circumferential direction, the blades ending at the face end (44) of the impeller (10) and which between them define blade chambers (20), in the pump chamber (12), at least one feed conduit (34) in the pump chamber (12), the feed conduit being in the form of a split ring that cooperates with the ring of blades (16) on the impeller (10), at least one intake opening (36) discharging into the feed conduit (34) embodied in a pump chamber wall (30) that defines the pump chamber (12) in the direction of the pivot axis (14) of the impeller (10), at least one outlet opening (40) discharges into the pump chamber (12), the feed conduit (34), in an initial region at the at least one intake opening (36) and/or in the circumferential direction (11) of the impeller (10), adjoining the impeller, extends radially farther inward than the blade chamber bottom (22) of the impeller (10); and the transition between a radially inner blade chamber bottom (22) of the blade chambers (20) and the associated face end (44) of the impeller (10) having a chamfer (46) or rounded corner (48).

2. The flow pump of claim 1, wherein the feed conduit (34), in its remaining circumferential region located outside the initial region, extends radially inward at least approximately equally far as the blade chamber bottom (22) of the impeller (10).

3. The flow pump of claim 2, wherein the radially inner edge (42) of the feed conduit (34), beginning at its initial region at the intake opening (36), extends continuously radially farther outward toward its remaining circumferential region.

4. The flow pump of claim 3, wherein the at least one intake opening (36) has a lesser width in the radial direction than the feed conduit (34) in its initial region.

5. The flow pump of one of claim 4, wherein the feed conduit (34) is embodied laterally beside the impeller (10), in the form of a groove in the pump chamber wall (30).

6. The flow pump of one of claim 3, wherein the feed conduit (34) is embodied laterally beside the impeller (10), in the form of a groove in the pump chamber wall (30).

7. The flow pump of claim 2, wherein the at least one intake opening (36) has a lesser width in the radial direction than the feed conduit (34) in its initial region.

8. The flow pump of one of claim 7, wherein the feed conduit (34) is embodied laterally beside the impeller (10), in the form of a groove in the pump chamber wall (30).

9. The flow pump of one of claim 2, wherein the feed conduit (34) is embodied laterally beside the impeller (10), in the form of a groove in the pump chamber wall (30).

10. The flow pump of claim 1, wherein the at least one intake opening (36) has a lesser width in the radial direction than the feed conduit (34) in its initial region.

11. The flow pump of one of claim 10, wherein the feed conduit (34) is embodied laterally beside the impeller (10), in the form of a groove in the pump chamber wall (30).

12. The flow pump of one of claim 1, wherein the feed conduit (34) is embodied laterally beside the impeller (10), in the form of a groove in the pump chamber wall (30).

* * * * *